US005518851A

United States Patent [19]

Katagiri et al.

[11] Patent Number: 5,518,851

[45] Date of Patent: May 21, 1996

[54] TONER

[75] Inventors: Yoshimichi Katagiri, Chigasaki; Yuzo Horikoshi, Isehara; Norio Sawatari, Sagamihara, all of Japan

[73] Assignee: Fujitsu Limited, Kawasaki, Japan

[21] Appl. No.: 329,504

[22] Filed: Oct. 26, 1994

Related U.S. Application Data

[62] Division of Ser. No. 981,995, Nov. 24, 1992, Pat. No. 5,389,485, which is a continuation of Ser. No. 718,897, Jun. 21, 1991, abandoned.

[30] Foreign Application Priority Data

Jun. 22, 1990 [JP] Japan ..... 2-165177
Jun. 22, 1990 [JP] Japan ..... 2-165178

[51] Int. Cl.[6] ..... G03G 9/00

[52] U.S. Cl. ..... 430/110; 430/904

[58] Field of Search ..... 430/109, 110, 430/111, 106, 904

[56] References Cited

U.S. PATENT DOCUMENTS

| | | | |
|---|---|---|---|
| 4,198,477 | 4/1980 | Williams et al. | 430/120 |
| 4,339,518 | 7/1982 | Okamura et al. | 430/126 |
| 4,388,396 | 6/1983 | Nishibayashi et al. | 430/126 |
| 4,626,488 | 12/1986 | Inoue | 430/126 |
| 4,640,881 | 2/1987 | Dennis | 430/106.6 |
| 4,666,813 | 5/1987 | Sakashita | 430/110 |
| 4,699,863 | 10/1987 | Sawatari et al. | 430/97 |
| 4,758,491 | 7/1988 | Alexandrovich et al. | 430/110 |
| 4,960,677 | 10/1990 | Seibles et al. | 430/331 |
| 4,978,596 | 12/1990 | Shimizu et al. | 430/109 |
| 5,025,067 | 6/1991 | Yamamoto et al. | 525/109 |
| 5,032,484 | 7/1991 | DeMejo et al. | 430/110 |

FOREIGN PATENT DOCUMENTS

| | | |
|---|---|---|
| 0197387 | 10/1986 | European Pat. Off. . |
| 2386847 | 3/1978 | France . |
| 3039224 | 4/1981 | Germany . |
| 59-129862 | 7/1984 | Japan . |
| 61-285459 | 12/1986 | Japan . |
| 1-25155 | 1/1989 | Japan . |
| 1-55569 | 3/1989 | Japan . |

OTHER PUBLICATIONS

Journal of Imaging Technology, vol. 11.11, No. 6, Dec. 1985, Springfield U.S., pp. 284–286; Narusawa et al: "Flash Fusible Toner for Laser Printers".

*Primary Examiner*—John Goodrow
*Attorney, Agent, or Firm*—Armstrong, Westerman, Hattori, McLeland & Naughton

[57] ABSTRACT

The present specification discloses a toner for electrophotography.

This toner comprises two or more kinds of binder resins, and is characterized in that the surface tension of each of the binder resins and the melt viscosity thereof, both at a temperature of 200° C., are respectively below 30 dyne/cm and 100 poises or more, and the melt viscosity thereof and the storage modulus thereof, both at a temperature of 125° C., are respectively below 5000 poises and below 40000 dyne/cm$^2$, a toner comprising a surface tension reducing agent and a binder resin. Because the melt viscosity of the binder resin at a temperature of 200° C. is 30 poises or more, a toner having an excellent void resistance can be obtained without a worsening of the fixability and blocking resistance thereof.

4 Claims, 3 Drawing Sheets

TONER

This is a division of application Ser. No. 07/981,995 filed Nov. 24, 1992 now U.S. Pat. No. 5,389,485, which is a continuation of application Ser. No. 07/718,897, filed Jun. 21, 1991, abandoned.

BACKGROUND OF THE INVENTION

1. Field of the Invention

The present invention is concerned with a toner used for developing an electrostatic latent image in, for example, electrophotography.

2. Description of the Related Art

In the electrophotography field, the method described in U.S. Pat. No. 229,761 etc. is widely used. In this method, uniform electrostatic charge is applied to a photoconductive insulator (Photocondrum, etc.) by corona charge, and an electrostatic latent image is formed by, e.g., light using various means, and then fine powder, i.e., toner, is electrostatically adsorbed to the latent image to thereby develop the image and make it visible, and if necessary, the toner picture image is transcribed onto a recording medium such as paper, and is fixed to the recording medium by, for example, pressure, heating, solvent vapor blasting or irradiation of light. As the toner used for developing the electrostatic latent image, there are employed particles obtained by pulverizing binder resin made of a natural or synthetic high molecular substance dispersing colorant such as carbon black. Usually a particle diameter of toner is about 5 to 20 μm. These particles are used for the development of an electrostatic latent image as toner alone, or mixed with carrier such as iron powder and glass beads.

The developing methods are classified into a one-component developing method and a two-component developing method. The toner used in the former method usually contains magnetic powder, which is frictionally charged by friction with the wall and the developing roller surfaces and is held on the developing roller by the magnetic force of a magnet incorporated in the roller. The toner is developed to the latent image portion of a photoconductive insulator by the rotation of the roller, whereby the charged toner alone is adhered to the latent image by electric attraction to carry out the development of the image.

In the latter developing method, developer consisting of toner and carrier is frictionally charged by being mixed and stirred in a developing device, and the toner is conveyed to the latent image portion of the photoconductive insulator while carried on the carrier, whereupon the charged toner alone is selectively adhered to the latent image by an electric attraction to carry out the development of image.

As the method of fixing the toner image, although a hot roller fixing method is conventionally employed, a flash fixing utilizing light energy generated by a Xenon lamp is now under development, due to its characteristics as described below.

(1) The flash fixing method does not lower the resolution of the picture image because of the non-contact fixing method.

(2) No waiting time is necessary after the current source is once switched off, and thus an immediate restart is possible.

(3) Even if a recording medium such as copy paper is jammed in a fuser due to a system malfunction, it will not burn.

(4) Any material and thickness of paper can be used for the recording medium, e.g., adhesive paper, preprinted form, and sheet of paper with different thicknesses, etc.

The process by which a toner is fixed to a recording medium by the flash fixing method is explained as follows.

The toner transferred to a recording medium is adhered to the medium in powdered state and forms a picture image. At this stage the image can be destroyed if rubbed with a finger.

When light is irradiated on the picture image by a Xenon lamp, the toner absorbs the energy of the light. The temperature of the toner is accordingly elevated, whereby the toner is softened and melted, and thus is closely adhered to the recording medium.

After the light has been extinguished, the temperature of the toner begins to fall and the toner is thus solidified, whereby a fixed picture image is formed.

A necessary condition for a toner is that the toner resin is softened at a comparatively low temperature, and at the same time, the picture image formed by the toner is not deformed even when the toner is in a molten state.

When a solid, such toner, is melted, however, the viscosity thereof is lowered and the melted toner is coagulated and deformed due to the surface tension thereof. In the present case, the picture image formed by the toner will be deformed.

As binder resin used for the toner, a low molecular weight polymer called oligomer is generally employed due to their low melting temperature and good thermal stability.

The oligomer, however, has defects such that a fixed picture image formed of such an oligomer is easily deformed due to the low melt viscosity and storage stability thereof, and thus the image quality is lowered. Further, when the light energy adsorbed by the toner is too strong, an explosive fixing is liable, to appear white voids called "image void", whereby the photographic density of the image is lowered.

FIGS. 1-(*a*), (*b*) and (*c*) illustrate how a void is formed. These figures show that, when a strong light 3 ((*b*) of this figure) is irradiated to a toner 1 ((*a*) of this figure) arranged in multiple columns on a sheet of recording paper 2, the toner 1 is easily melted due to the low softening temperature thereof, and a void 5 is formed inside the toner for the reasons described in the following. Note, 4 in FIG. 1 is a fixed picture image.

When the temperature of a part of toner 1 is elevated to the decomposition temperature thereof, a gas is produced by this decomposition, whereby the part of the toner is protruded, and thus the void 5 is formed.

The air in the empty spaces among the toner particles is thermally expanded and the toner is protruded, whereby a void 5 is formed.

The void 5 formed according to the above mechanism, is formed by explosive fixing.

Even where the toner 1 absorbs energy strong enough to melt, if the melt viscosity and storage stability of the binder resin 1 are too low, compared with the surface tension thereof, the toner aggregate due to the surface tension thereof before the once melted toner 1 cakes, and thus the void 5 may be formed. The shorter the fixation time is, i.e. the faster the printing speed of a printer or a copying machine is, the greater amount of energy irradiated in a short time is necessary to carry out the fixing, and accordingly the above void forming phenomenon occurs more frequently. This phenomenon becomes particularly conspicuous when a high speed machine with a processing speed of 700 mm/sec or more is employed.

As a means of solving the above problems, the molecular weight of a binder resin is merely enlarged. Although the melt viscosity and storage elastic modulus of the toner 1 become higher, the melting point thereof also becomes higher, so the fixability of toner 1 is worsened.

Namely, in a light fixing, as an instantaneous light energy is given to the upper part of the accumulated toners 1. The heat generated by this energy is transmitted to the lower part of toner 1, and the fixing is conducted by the melting of the lower part of the toner (refer to Japanese Patent publication No. 55-140860). Namely, a temperature difference occurs between the upper part and lower part of the toner 1, and the lower part of the toner 1 has a comparatively low temperature. Accordingly, when the melting point of toner 1 is elevated, the lower part of toner 1 is not substantially melted. Thus the fixability is extremely poor. When the thickness of the toner 1 accumulated by developing is greater, the above phenomenon becomes more conspicious. When the thickness of toner 1 after the fixing exceeds 20 μm, a good fixability cannot be maintained. It is, however, difficult to always maintain the thickness of toner 1 to be developed at a constant value.

Further, as the toner 1 for the light fixing, a low molecular resin with a lower softening temperature than the polymeric binder resin to be used in the toner 1 for a hot roller fixing is often employed, and thus a blocking phenomenon may occur such that the toner surface is softened when exposed to high temperature environment and the toners are merged.

When the above blocking phenomenon occurs, the fluidity of the toner 1 becomes extremely low, and not only is the toner not smoothly supplied into the developing vessel but also the particle diameter, etc., thereof changes, whereby the electrification property thereof also changes and a good developed image cannot be obtained.

Therefore, it has been necessary to develop image 1 that exhibits a good fixability even if the amount of toner 1 thereof changes, and in which neither the formation of voids 5 nor a blocking phenomenon will occur.

As described above, in the toner resin for electrophotography in which a light fixing system is employed, as the binder therefor, there are commonly employed an epoxy resin represented by bisphenol A diglycidyl ether, etc. When such a resin is to be used as binder resin, it has been necessary to employ an oligomer with a low softening temperature, i.e. a comparatively lower molecular weight, to show good fixability. Such an oligomer is liable to cause an explosive fixation due to a thermal decomposition thereof, and has a defect such that, owing to the high surface tension and melt viscosity thereof, voids are produced due to the aggregation of the toner particles and the image quality is lowered. Further, the blocking phenomenon occurs when the toner is exposed to a high temperature environment.

To solve these problems, it is necessary to heighten the melt viscosity of a binder resin but not to produce any white voids due to a movement of the binder resin. As a means of heightening the melt viscosity of the binder resin, the following methods are considered:

(1) heighten the polymerization degree of the binder resin.

(2) introduce a comparatively long side chain containing 4 or more carbon atoms into the main chain structure.

(3) introduce a cross-like among the main chain structures of the binder resin.

In methods (1) and (3), however, although the melt viscosity of the binder resin may be heightened, the melting point thereof is also elevated, and although void formation may be prevented, the fixability is often degraded. In method (2), although the melt viscosity of the binder resin may be heightened without elevating the melting point thereof, the blocking resistance is often greatly worsened, and the glass transition point of the binder resin is lowered in this case.

SUMMARY OF THE INVENTION

The present invention has been created in order to solve the problems as described above, and the object thereof is to provide novel toner having an excellent void forming resistance without lowering the fixability and blocking resistance thereof.

Figure 1A:
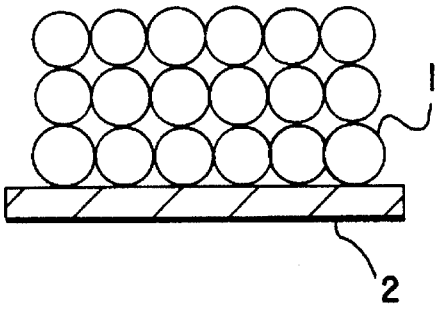
FIG. 1 is an explanatory view of void formation.
Figure 1B:
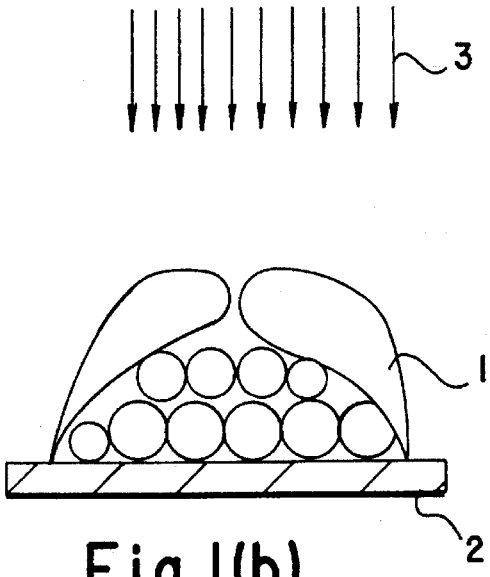
Figure 1C:
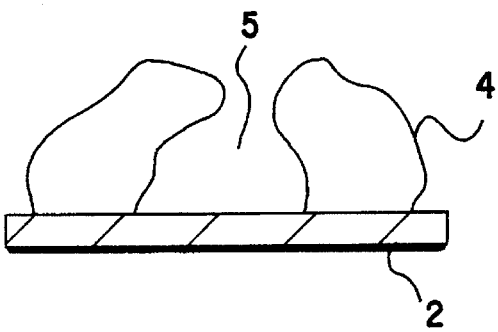
Figure 2:
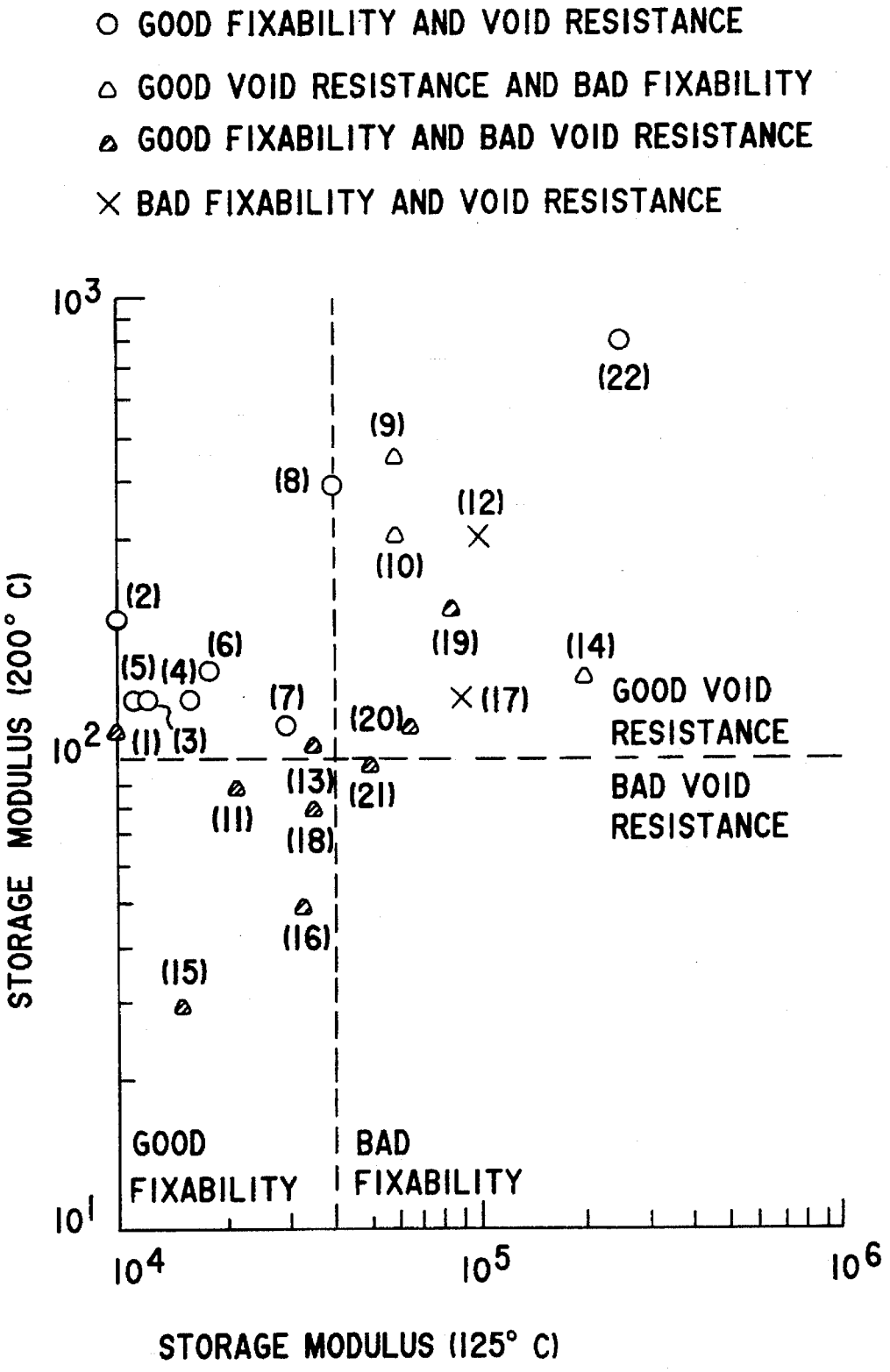
FIG. 2 is a graph plotting storage moduli (125° C., 200° C.) of a binder resin.
Figure 3:
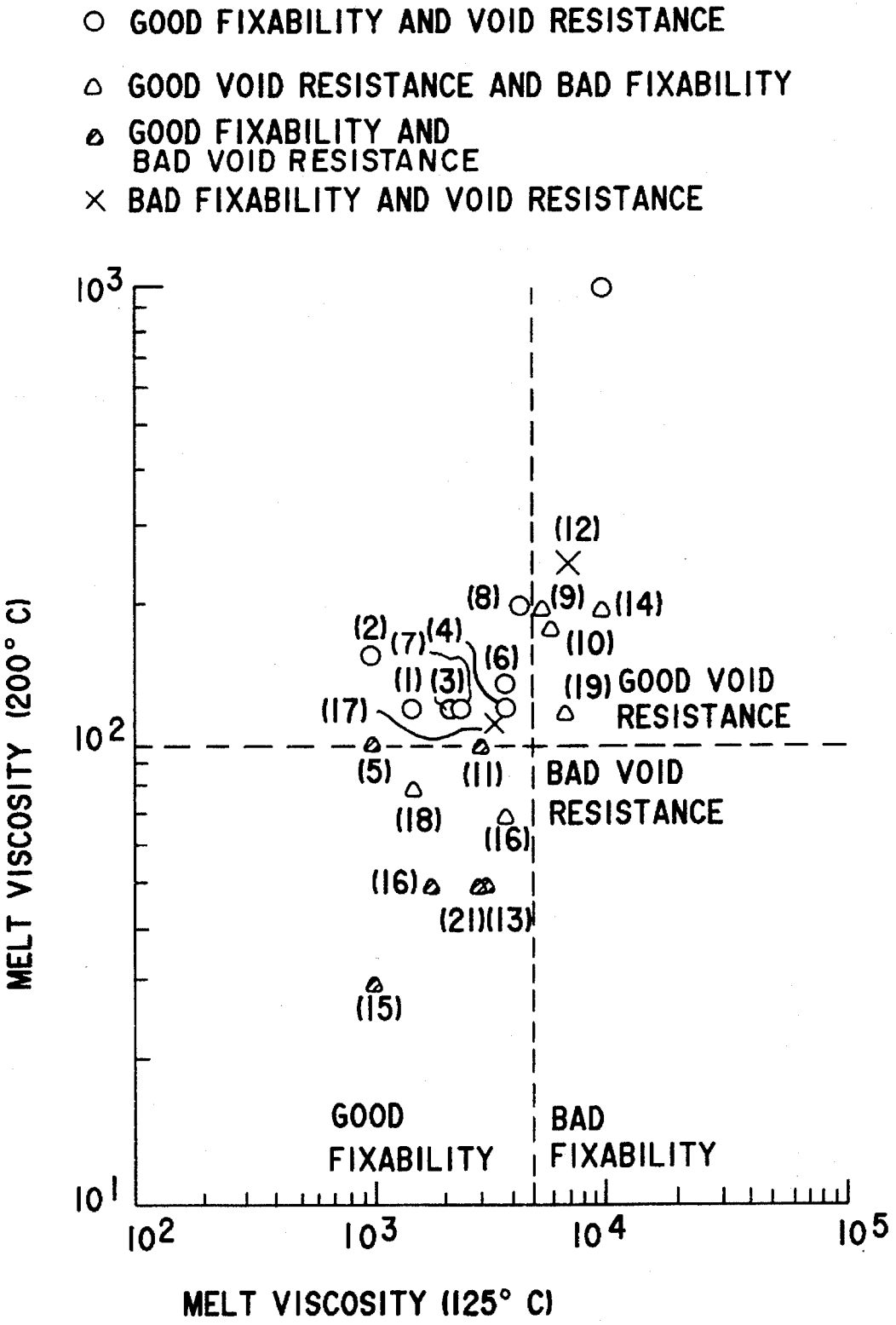
FIG. 3 is a graph plotting melt viscosities (125° C., 200° C.) of the binder resin.

The figures attached to each of the marks, ○, Δ, ▲, and x in FIGS. 2 and 3 correspond to the numbers of the hereafter-described binder resins.

DESCRIPTION OF THE PREFERRED EMBODIMENTS

The present inventors studied the afore-described problems, and found that these problems could be solved by adopting a binder resin with certain physical property values, using two means, in a toner comprising binder resins. The first means is described below.

Namely, the present invention is a toner comprising two or more kinds of binder resins, characterized in that each of the blended binder resins has a surface tension below 30 dyne/cm, a melt viscosity of 100 poises or more, and a storage modulus of 100 dyne/cm$^2$ or more, these being determined at a temperature of 200° C., and a melt viscosity below 5000 poises and a storage modulus below 40000 dyne/cm$^2$, these being determined at a temperature of 125° C.

The binder resin mixture consists of a resin binder with a melt viscosity of 30 poises or more and a storage modulus of 50 dyne/cm$^2$ or more, these being determined at a temperature of 200° C., a melt viscosity below 3000 poises and a storage modulus below 35000 dyne/cm$^2$, those being determined at a temperature of 125° C. and a binder resin with a melt viscosity of 120 poises or more and a storage modulus of 120 dyne/cm$^2$ or more at a temperature of 200° C. and a melt viscosity below 10000 poises and a storage modulus below 100000 dyne/cm$^2$ or more at a temperature of 125° C. In addition, as an individual binder resin constituting the above binder resin mixture, there is preferably employed a main chain-modified copolymer wherein, into a first prepolymer or monomer constituting the main chain structure of the binder resin by the polymerization thereof, there is introduced a second prepolymer exhibiting a rubber-like elasticity at normal temperature and having 1.5 equivalent or more of a functional group reactive with the first prepolymer or monomer, or a monomer convertible into the same compound as the second prepolymer by the polymerization thereof.

The second means is now described.

Namely, the present inventors found after intensive studies that, even when a binder resin with a comparatively low melt viscosity is employed to prevent the lowering of the fixability of a binder resin accompanying the elevation of the melting point thereof and the lowering of blocking resistance thereof accompanying the lowering of the glass transition point thereof, a void formation arising from aggregation can be controlled by employing at least a substance for lowering the surface tension of the binder resin or an intermolecular force acting among the molecules constituting the binder resin, i.e., by employing a toner with surface tension diminished by dispersing a surface tension decreasing agent in the binder resin, and thus achieved the present invention.

Namely, the toner of the present invention comprises a surface tension lowering agent and binder resins, and is characterized in that the melt viscosity of the binder resins and the surface tension thereof at a temperature of 200° C. are, respectively, 30 poises or more and below 15 dyne/cm.

The binder resin constituting the toner in the above second means is not a binder resin mixture but a simple binder resin, unlike the toner in the afore-described first means.

The present invention is now explained more in detail, starting with an explanation of the first means.

The reasons for the setting of the measurement temperatures for the physical property values, such as the surface tension and melt viscosity, are as follows.

First, with respect to the light fixing processes of a toner in a time series, the following 3 stages are considered.

(1) Light irradiating stage; When light is irradiated to the toner, the toner absorbs the energy of the light and generates heat, and the temperature of the surface of the toner instantly becomes very high.

(2) Heat conduction and percolation stage; The heat on the surface of the toner is conducted to the toner on the lower layer and the whole of the toner is softened and melted to be thereby percolated in the recording medium.

(3) Cooling and fixing stage; The temperature of the toner falls, and the toner is solidified to form a fixed picture image.

The physical behaviors such as surface tension participating in the void formation are based on the physical properties of the surface of the toner or the middle to upper layers thereof at which the toner is melted at a high temperature. On the other hand, as the fixability of the toner is based on the behaviors thereof, e.g., the melt viscosity up to the time the toner is cooled and solidified and the permeability thereof into a recording medium, at the lower layer of the toner where the toner is maintained at a comparatively lower temperature, it is evident that the thermal, dynamic and chemical behaviors of the toner, which participate deeply in the fixability and void formation, cannot be discussed merely as a temperature such as the softening point of the binder resin. In addition, the surface tension, melt viscosity etc., which constitute the essential points of the present invention, are physical property values with a temperature dependency, and therefore, differ greatly depending upon the temperatures at which they are measured, and at the same time, their temperature dependencies vary greatly according to the toner-constituting materials such as the material of the binder resin, etc.

Hitherto, with respect to a binder resin to be used for light fixing, the melting point of the binder resin is specified in Japanese Unexamined Patent Publications (KOKAI) Nos. 57-79957 and 63-66563, and the melt viscosity thereof at the softening point thereof is specified in Japanese KOKAI No. 58-215660. With respect to the fixability, the viscoelasticity of a toner on the surface contacting a recording medium is important, but with respect to voids, the surface tension and melt viscoelasticity at the upper layer of a toner are important, and based on the present inventors' experience, even if a toner satisfies the physical property values described in the above patents, an excellent light-fixed picture image is not always obtained.

Thus, in making the present invention, the temperatures at the upper layer portion and the lower layer portion of the toner at each stage of the above light fixing were assumed on the basis of the following experiments.

(1) Presumption of the temperature at the upper layer portion of a toner

The aggregation of a toner due to the surface tension thereof, which becomes a main cause of void formation, occurs when the toner immediately after the irradiation of flash light is at a comparatively high temperature and the melt viscosity and storage modulus of the toner are low. Thus, the temperature of the upper portion of the toner was first assumed on the basis of the temperature at which the binder resin was exposed and of the components of heat decomposed fragment produced at that time.

First, the gas produced by the decomposition of the toner and the gas produced when light was irradiated to the toner and the toner was melted were collected, and the component identification of the collected gas was conducted by gas chromatography-mass spectrometry (GC-MS method). Then, another toner with the same composition as the above toner was melted at a constant temperature in a heating furnace, and the gas produced by the decomposition of the toner and the gas produced at the time of melting were collected, and the component identification of the collected gas was conducted in the same manner as above. The gases were compared, and the temperature at which a decomposition gas having the same components as that produced by the light melting was produced was obtained, and the result set forth in Table 1 was obtained. It was assumed on the basis of this result that the upper portion of the toner at the time of light fixing reached a temperature above 200° C.

(2) Assumption of the temperature in the lower portion of a toner

On the other hand, for the fixability, the melt viscosity and storage modulus of the lower portion of a toner, which portion is brought into contact with a recording medium, constitute important factors. Thus, with respect to 5 kinds of toners with different melting properties, the temperatures attained by the lower portion of each toner when the optimum fixing energy was given to each toner were assumed as follows. The optimum fixing energy referred to herein means the energy due to which a toner exhibits a sufficient fixing strength, and by which explosive fixing etc. resulting from excessive energy do not occur.

Namely, employing 5 kinds of polyester toners with melting points (flow tester method) of 105° C., 115° C., 125° C., 138° C. and 150° C., fixing tests were first conducted while irradiation energy was altered by controlling the charge voltage of a capacitor for light generation, to obtain the optimum fixing energy for each toner. Subsequently, a thin film with a thickness ranging from 1 to 3 μm made of a pure substance with a known melting point was formed on a recording medium, and a toner layer with a thickness of about 10 μm was formed on the upper surface of the above film, following which light was irradiated thereon to thereby melt the toner. Then, the temperature of the lower layer of each toner when optimum fixing energy was given was presumed according to whether the pure substance sandwiched between the toner layer and the recording medium was melted or not. The pure substances employed were phenyl acetic acid (melting point: 76° C.), benzil (melting point: 95° C.), acetoanilide (melting point: 95° C.), phemidone (melting point: 121° C.), phenacetin (melting point: 135° C.), phenanthrol (melting point: 156° C.) and benzanilide (melting point: 163° C.).

The result obtained is set forth in Table 2.

It was assumed from this table that the temperature of the lower layer of the toner was within the range from 120° to 135° C.

On the basis of the above result, it has been confirmed that with regard to the surface tension, melt viscoelasticity at a high temperature etc. which constitute the main factors of void formation, discussion should be made of the physical property values at temperatures of 200° C. or more, and with respect to the melt viscosity etc. participating in the fixability, the physical behaviors should be discussed with the temperature range of about 125° C. In the present invention, the temperature at which the physical properties under high temperature melting should be discussed is set as 200° C. This is based on the present inventors' experience, and whether the fixing behavior of a toner is good or bad can be assumed with the physical property values of the toner at a temperature of 200° C. as indicators, and that at a temperature higher than 200° C., the heat decomposition and heat polymerization of the resin become more violent and the discussion on clear physical property values becomes difficult.

Note, the above experiment was carried out by employing a printer adopting therein a light fixing system (F-6700D; manufactured by Fujitsu K. K.) with a charging voltage of from 1450 V to 2550 V of a capacitor for light generation.

The present inventors' examinations resulted that, as described above, an excellent light fixability and void resisting characteristic can be joined when the physical properties of the binder resins used for a toner are characterized in that the surface tension, melt viscosity and storage modulus at a temperature of 200° C. are, respectively, below 30 dyne/cm (Wilhelmine's method), 100 poises or more and 100 dyne/cm$^2$ or more, and melt viscosity and storage modulus at a temperature of 125° C. are, respectively, below 5000 poises and below 40000 dyne/cm$^2$. However, if the means commonly employed for heightening the melt viscoelasticity of a binder resin when melted at a high temperature are, e.g. (1) enlarging the molecular weight of the binder resin, and (2) introducing cross-linking structures among the molecules of the binder resin, etc., the melting point and melt viscoelasticity at the time of low temperature melting of a toner are also made higher, so that the fixability thereof is worsened, and thus it has been difficult to satisfy both properties.

In the present inventors' investigations it was found that, when a binder resin exhibiting a high melt viscosity and high storage modulus at the time of high temperature melting and a binder resin exhibiting a low melt viscosity and low storage modulus at the time of low temperature melting are employed as a blend whenever occasion demands, to cause the temperature characteristics of the melt viscosity and storage modulus of a binder resin to be comparatively higher at a high temperature (in concrete, 100 poises or more, and 100 dyne/cm$^2$ or more) and to hold them down at a lower temperature (in concrete, below 5000 poises and below 40000 dyne/cm$^2$), the above conditions can be comparatively easily satisfied.

Namely, by employing a blend of binder resins with a melt viscosity of 30 poises or more and a storage modulus of 50 dyne/cm$^2$ or more at a temperature of 200° C. and a melt viscosity below 3000 poises and a storage modulus below 35000 dyne/cm$^2$ at a temperature of 125° C. as binder resin exhibiting a low melt viscosity and storage modulus at the time of low temperature melting and a binder resin with a melt viscosity of 120 poises or more and a storage modulus of 120 dyne/cm$^2$ or more at a temperature of 200° C. and melt viscosity below 10000 poises and a storage modulus below 100000 dyne/cm$^2$ at a temperature of 125° C. as binder resin exhibiting a high melt viscosity at the time of high temperature melting, it becomes possible to keep the melt viscosity and storage modulus of the whole blend of the binder resins below 5000 poises/below 40000 dyne/cm$^2$ at 125° C. and 100 poises or more/100 dyne/cm$^2$ or more at 200° C.

In addition, the lower limits of the melt viscosity and storage modulus at 200° C. of the binder resin exhibiting a low melt viscosity and low storage modulus at the time of low temperature melting are set, respectively, as 30 poises and 50 dyne/cm$^2$ because, in the present inventors' experience, when a binder resin with a melt viscosity and storage modulus, respectively, lower than the above limits is employed for blending, even if a binder resin exhibiting a high melt viscosity and high storage modulus at the time of high temperature melting is blended with the above binder resin, the melt viscosity and storage viscosity of the whole blend of the binder resins often face below the desired values and in an extreme case, problems arise due to the great difference between the melt viscosities of the binder resins, and the binder resins give rise to a phase separation.

On the other hand, the reason wily the melt viscosity and storage modulus at a temperature of 125° C. of the binder resin exhibiting a high melt viscosity and high melt elastic modulus at the time of high temperature melting are set, respectively, below 1000 poises and below 100000 dyne/cm$^2$ is that, when the melt viscosity and storage modulus of this binder resin are higher, respectively, than the above values, even if this binder resin is blended with a binder resin with a low melt viscosity and low storage modulus, the permeability of the blended binder resins into a recording medium is worsened, and therefore, a poor fixing is obtained.

In addition, also in the binder resin used in the above blending, a low melt viscosity and low storage modulus are required at the time of low temperature melting, and a high melt viscosity and high storage modulus are required at the time of high temperature melting, although these degrees are different. From the present inventors' experience, it is difficult to obtain a binder resin exhibiting a low melt viscosity and low storage modulus at the time of low temperature melting and exhibiting a high melt viscosity and high storage modulus at the time of high temperature melting, and it is difficult to obtain a binder resin satisfying the present temperature-melt viscosity and storage modulus properties even for binder resins for blending merely by the control of the molecular weight of the binder resin or by the partial alteration of the molecular structure thereof, e.g., by the introduction of a cross-linking structure, as described above.

Thus, from the present inventors' investigations it was found that, as a means of obtaining a binder resin exhibiting a high melt viscosity and high melt elastic modulus at the time of high temperature melting while an extreme elevation of the softening point of the binder resin and a rise of the melt viscoelasticity thereof are prevented, a main chain-modified copolymer, the main chain of which has been modified by introducing thereinto a component exhibiting rubber-like elasticity, may be appropriately employed as binder resin.

As the means of causing the melt viscoelasticity of a binder resin at the time of melting to be heightened, there may be considered the following methods as described above, besides the method of the present invention:

(1) to heighten the polymerization degree of the binder resin, (2) to introduce many comparatively long side chains containing 4 or more carbon atoms into the main chain structures of the binder resin, (3) to introduce cross-links among the main chain structures, etc.

According to methods (1) and (3), the softening point, melt viscosity at the time of low temperature melting and storage elastic modulus increase generally as the melt viscosity and storage modulus increase, so that although a void formation may be prevented, the fixability often becomes poor. On the other hand, according to method (2), though it is possible to elevate the melt viscosity at the time of high temperature melting without elevating so much the softening point or melt viscosity and storage modulus at the time of low temperature melting, the degree thereof is insufficient, and in this case, the glass transition point of the binder resin is lowered and the blocking resistance in a high temperature environment is often extremely poor.

The method shown in the present invention, in which there is employed a main chain-modified copolymer with the main chain modified by the introduction of a component exhibiting rubber-like elasticity, is a technique in which, by introducing rubber-like elastic components with a very low crystallinity into the main chain structure of a polymer with a comparatively good crystallinity represented by epoxy and polyester, the crystallinity of the main chain structures is lowered, whereby a binder resin exhibiting a softening point and melt viscosity at the time of low temperature melting and storage modulus almost equal to those of an epoxy binder resin employed commonly as binder resin, for flash fixing is obtained, even though it has main chain structures of longer chain than those of an epoxy binder resin employed commonly as binder resin for flash fixing.

In addition, as such a binder resin described above has main chain structures of a longer chain than an epoxy binder resin etc. employed commonly as binder resin for flash fixing and has a region exhibiting rubber-like elasticity with high flexibility in the main chain structures, the intertwinement of the main chain structure is so strong that a high melt viscosity can be maintained even at a comparatively high temperature.

As prepolymer, in which main chain structures used in the present invention are formed, any resins which have commonly been employed as binder resin for a toner, e.g., an epoxy resin, styrene-acryl resin, polyester resin, vinyl series resins etc. may be employed as long as it has reactivity with a rubber elastic component. However, owing to the introduction of the component with rubber-like elasticity, the hardness of the binder resin is lowered to some extent and the pulverization of the toner after the kneading thereof is likely to become difficult, so that a resin with a comparatively good crystallinity and high hardness is more preferably used as prepolymer forming the main chain structures.

In addition, from the present inventors' experience, when composing the main chains of bisphenol type epoxy, the epoxy equivalent of the copolymer after the modification of the main chain thereof is desirably from 750 to 1000, and the weight-average molecular weight of a molecule after the modification of the main chain thereof is desirably from 3000 to 50000. This is because, when a main chain-modified copolymer with a molecular weight smaller than the above range is employed, the desired relationships among the temperature, melt viscosity and melt elastic modulus is difficult to obtain, and when a main chain-modified copolymer with a molecular weight larger than the above range is employed, the binder resin is difficult to soften and the fixability is often lowered.

In addition, as the component exhibiting a rubber-like elasticity used in the present invention, polybutadiene, or copolymers, containing butadiene in a structural unit etc., e.g., 1,4-trans-polybutadiene, 1,4-cis-polybutadiene, 1,2-polybutadiene, butadiene-acrylonitrile copolymer, butadiene-styrene copolymer, butadiene-methyl methacrylate copolymer, butadiene-methyl vinyl ketone copolymer etc. may be employed.

Furthermore, it is desirable for these components exhibiting a rubber-like elasticity to have at the terminals functional groups for imparting reactivity with the molecules forming the main chain structures, e.g. epoxy group, carboxyl group, hydroxyl group etc.

Though the molecular weight of the present component exhibiting a rubber-like elasticity and the amount of modified main chain are optional, the molecular weight of from 1000 to 5000, and the amount of modified main chain of from 5 to 30 wt % are more desirable. The reason why the molecular weight of the rubber-like component used for the modification of the main chain is desirably about 1000 to 5000 is that the introduction of the component exhibiting rubber-like elasticity into the main chain in the form of block results in a greater effect of degrading the crystallinity of the main chain after its modification, and that when an oligomer with a molecular weight of from about 1000 to about 5000, in which several molecules of the rubber-like component are polymerized, is employed as modifying agent, a main chain-modified copolymer to be obtained by such block copolymerization may be comparatively easily obtained.

The reason why the amount of modified main chain is desirably within the range of from 5 to 30 wt % based on the weight of the component constituting the main chain is that when such amount is below 5 wt %, the effect of elevating the melt viscosity at the time of melting as described before is often difficult to obtain, and when such an amount exceeds 30 wt %, the problems due to the introduction of the rubber-like component, e.g. the problem that the hardness of the main chain-modified copolymer is lowered, and when it is employed as toner binder resin, the pulverization of the toner after the kneading thereof becomes difficult, etc., are likely to arise.

Although the process for the preparation of the main chain-modified copolymer may be optionally adopted, e.g., when the prepolymer building up the main chain structure is a bisphenol series epoxy resin, bisphnol type epoxy resin oligomer, bisphenol compound, butadiene and/or isoprene as main monomers and an oligomer containing 1.5 equivalent or more of a reactive hydrogen radical reactive with the epoxy group as indispensable constitutive component are reacted to thereby obtain a main chain-modified copolymer.

In a like manner, when the prepolymer building up the main chain structure is polyester, polyester oligomer and butadiene and/or isoprene as main monomers and an oligomer containing 1.5 equivalent or more of an active hydrogen radical reactive with carboxyl group and/or hydroxyl group as indispensable constitutive component are reacted to thereby obtain a main chain-modified copolymer.

In addition, when the prepolymer building up the main chain structure is hydroxylated styrene-acryl or carboxylated styrene-acryl, styrene-acryl oligomer and butadiene and/or isoprene as main monomers and an oligomer containing 1.5 equivalent or more of an active hydrogen radical reactive with hydroxyl group or carboxyl group as indispensable constitutive component are subjected to esterification reaction to thereby obtain a main chain-modified copolymer.

Furthermore, to reduce the harmful influence resulted from the introduction of the rubber-like component, it is effective to employ subsidiarily the means of introducing partially cross-linked structures among the main chain and thereby heighten the melt viscosity and melt elastic modulus at the time of high temperature melting.

As a concrete means thereof, there is known a method of conducting crosslinking among the epoxy rings of the main chain with a compound containing in a molecule 3 equivalents or more of an active hydrogen reactive with the epoxy group, e.g. N-aminoethylpiperadine, diethylenetriamine, triethylene tetramine, methaxylenediamine, diaminodiphenylmethane etc., when the main chain skeleton is an epoxy, a method for causing a compound containing in a molecule 3 equivalents or more of carboxyl or hydroxyl groups, e.g. trimellitic acid, glycerine, pentaglycerol, pentaerythritol, 4,6-dioxy-2-methylbenzophenone etc. to contain in the main chain in an appropriate amount as constitutive monomer of the main chain, if the main chain is a polyester chain, and a method of causing a monomer containing in a molecule 2 equivalents or more of unsaturated bonds, e.g., divinylbenzene etc. to be contained in the main chain in an appropriate amount as constitutive monomer of the main chain, if the main chain is styrene-acryl.

In addition, when a nitrogen-containing compound is employed as one of the above crosslinking agents, by selecting the structure of the nitrogen-containing compound and the number of nitrogen atoms in the compound, additional advantages may be obtained such that the changeability of the binder resin can be controlled with good accuracy.

Although the present main chain-modified copolymer with the main chain modified by the introduction of a component exhibiting rubber-like elasticity may be used alone as binder resin, it is more desirable to blend same with other binder resin, e.g., an epoxy resin, styrene-acryl resin, polyester resin, vinyl series resin etc.

The first reason why the blending of binder resins is desirable is that, by blending binder resins as described above, the relationship between the temperatures, melt viscosity and storage modulus of the binder resin may be controlled comparatively easily.

The second reason therefore is that, by subjecting a copolymer to a main chain modification with a compound with a rubber-like elasticity as described above, some degree of lowering of the strength of the copolymer cannot be avoided, and when the thus main chain-modified copolymer alone is employed, the lowering of the pulverization efficiency of toner is unavoidable. From the above viewpoint, as a binder resin to be blended with the above main chain-modified copolymer, harder and more fragile resins, e.g. an epoxy resin, a non-crosslinked polyester formed by the polycondensation of short chain straight chain diol and aromatic dicarboxylic acid, etc., are more desirable.

The third reason therefor is that although main chain-modified copolymer with the main chain modified by the introduction of a component exhibiting rubber-like elasticity suffers degradation in the glass transition temperature in a lower degree than when the copolymer contains in the side chain a component exhibiting rubber-like elasticity, the glass transition temperature is lowered in owing to the presence of such a component, and widen this main chain-modified copolymer alone is employed as a binder resin, the toner is likely to cause blocking in a high temperature environment. From the above viewpoint, as a binder resin to be blended, a binder that satisfies the above-described relation among temperature, melt viscosity and storage modulus and has a high glass transition temperature is desirable. The present inventors' investigations resulted in the conclusion that the glass transition temperature of a binder resin to be blended with the above main chain-modified copolymer is desirable 70° C. or more, and the amount of thereof is desirably 50 wt % or more based on the whole of the blended binder resin.

The fourth reason therefor is that the surface tension of a blend of binder resins with different structures becomes smaller than that of the independent binder resin. This is due to the fact that, as a binder resin for toner, there is often employed an oligomer or a polymer with some degree of polar groups, and intermolecular attractions are produced owing to the orientation of the polar groups resulting from hydrogen bonding etc., which heighten the surface tension of the toner, tension of the toner is lowered.

In addition, from the present inventors' experience, when as a binder resin for a toner, a binder resin with a melting temperature below 125° C., a weight-average molecular weight below 20000 and a narrow ranging molecular weight distribution i.e. the ratio of weight-average molecular weight/number average molecular weight below 4.0, is employed, the toner is instantly melted when it is irradiated by light, and therefore, such a binder resin is more suitable for a device for conducting a light fixing.

The binder resin exhibiting a physical property as described above can be found among non-crosslinked epoxy resins and non-crosslinked amorphous polyester resins.

In addition, to present a phase separation among binder resins at the time of melting thereof in the fixing process etc., when the binder resins are blended, the binder resins to be blended are more desirably partially reacted in the kneading stage at the time of manufacturing the toner, and form a partially crosslinked material.

The second means for attaining the object of the present invention is now explained.

The second means is concerned with a toner containing binder resins, in which a surface tension lowering agent is contained and as the surface tension decreasing agent, there is employed a non-ionic surface active agent.

The second invention is now explained more in detail.

As polymer to be used as surface tension reducing agent, there may be employed a surface active agent having hydrophilic and hydrophobic groups and exhibiting surface activity e.g. polydimethylsiloxane-polyether, polydimethylsiloxane-polyester represented by the following general formulas,

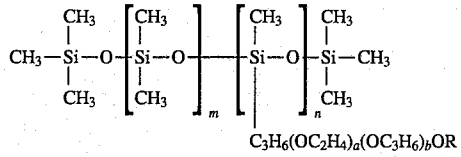

R: an alkyl group or H 0.1<b/a<10

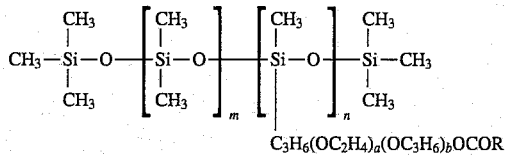

R: an alkyl group or H, 0.1<b/a<10, or fluorine polymers represented by the following formula

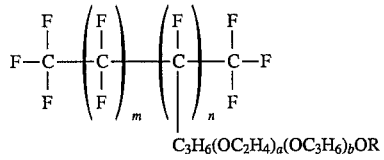

R: an alkyl group or H 0.1<a/b<10,

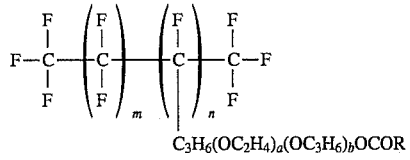

R: an alkyl group or H 0.1<a/b<10 etc. may be employed.

The silicone polymer used as surface tension reducing agent may be added to the binder resins at the stage of polymerizing the binder resins from monomers or at the stage of melting and kneading the toner-constituting materials. However, where the surface tension reducing agent is added to the binder resins at the stage of the polymerization of the binder resins, the surface tension reducing agent is confined to a material that does not impede the polymerization of the binder resins and no secondary reaction is induced therefrom.

In addition, the weight-average molecular weight of silicone polymer is preferably from $5\times10^2$ to $5\times10^4$, and as the number average molecular weight is increased, the dispersibility of the silicone polymer into the binder resins is lowered.

Although the amount of the added surface tension reducing agent is determined depending upon the material of the surface tension reducing agent and the surface tension of the binder resins, the surface tension is preferably below 15 dyne/cm at a temperature of 200° C. when a polyester resin (polyethylene terephthalate) is employed, which value corresponds to 0.01/2.00 wt % based on the weight of the toner. The reason why the amount of added silicone polymer should be below 2.00 wt % is that, if the amount exceeds this limit, due to the surface tension reducing agent's effect of lowering the melt viscosity of the binder resin, the melt viscosity thereof becomes too low and therefore the void formation preventing ability thereof is lowered. In addition, the reason why the lower limit of the amount of added silicone polymer should be 0.01 wt % is that, if the amount is below said value, the void formation preventing ability resulted from the lowering of the surface tension cannot be obtained.

As a non-ionic surface active agent other than the pendant type silicone polymer, polyethylene glycol ether or polyethylene glycol polyester represented by the following formula $$RCOO(CH_2CH_2O)_nOR'$$

wherein R and R', respectively, indicates an alkyl group or a hydrogen atom and $40\geqq n\geqq 10$ or $$RCOO(CH_2CH_2O)_nCOR',$$

wherein R and R', respectively, indicates an alkyl group or a hydrogen atom and $40\geqq n\geqq 10$ etc. may be employed. When these aliphatic non-ionic surface active agents are employed, it is necessary to add them in a proportion of 5 wt % or more (normally within the range of from about 10 to about 20 wt %) to reduce the surface tension to a sufficient degree. In the above case, although the surface tension is reduced simultaneously with the addition of the non-ionic surface active agent, the melt viscosity is also markedly lowered, so that the void formation preventing ability is also degraded. Therefore, the amount of polyethylene glycol ether or polyethylene glycol ester should be below 50 wt %.

As the polyethylene glycol ether or polyethylene glycol ester used as the surface tension reducing agent is hydrolyzed under high temperature conditions, it is impossible to add same and disperse it into the binder resin when synthesizing the binder resin.

In addition, as surface tension reducing agent, polyethylene wax and polypropylene wax (weight average molecular weight: $2\times10^3$ to $2\times10^4$) represented by the following general formula

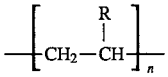

wherein R is a hydrogen atom or group $CH_3$ may be employed.

In the above case, to reduce the surface tension to a sufficient degree and prevent void formation, the amount of added surface tension reducing agent should be form 2 to 20 wt %.

As toner binder resin used in the present invention, any employable for electrophotography, e.g., styrene acryl, epoxy resin, polyester resin, etc., may be employed independently or in combination. When a binder resin with a surface tension reducing agent dispersed therein is combined with an other binder resin, a binder resin mixture with a surface tension reducing agent added only to one binder resin may be employed, as long as a required amount of surface tension reducing agent is added to the whole of the binder resin mixture.

The toner employed in the present invention may be produced by a known process. That is, binder resins, a coloring agent, surface tension decreasing agent, carbon, an charge control agent etc. are melted and kneaded by, e.g., a pressure kneader, roll mill, extruder, etc., and thereby dispersed uniformly, following which the uniformly dispersed mixture is finely pulverized, e.g., by a jet mill etc., and the thus obtained powder is classified by a classifier such as an air classifier to thereby obtain the desired toner.

The various physical properties were determined by the following measuring methods.

(1) Surface tension

Surface tension is the value determined at a temperature of 200° C. by employing a Wilhelimie method surface tension measuring equipment equipped with a constant-temperature sample holder with a temperature controlling range of ±0.5° C., "Digiomatic ESB-V" (manufactured by Kyowa Kagaku K. K.).

(2) Melt viscosity/storage modulus

Melt viscosity and storage modulus are values obtained by the measurement of a temperature rise from 50° C. to 250° C. at a programming rate of 10° C./min in a nitrogen atmosphere by employing a cone plate type dynamic viscoelasticity measuring equipment, "MR-3 Soliquid Meter [phonetic]" (manufactured by K. K. Rheology). Note, the frequency in this case was set as 0.5 Hz.

(3) Melting point

Melting point is the value obtained when a temperature rise flow test was carried out by employing a flow tester, "Shimazu Flow Tester CFT-500" (manufactured by K. K.

Shimazu Seisakusho) and the plunger lowered by 4 mm. The conditions of the temperature rise flow test were as follows.

| | |
|---|---|
| Die | 1 mm × 1 mm ϕ |
| Sample | 1.5 g pellet |
| Preheating temperature | 60° C. |
| Preheating time | 300 sec. |
| Programming rate | 6° C./min |
| Loading | 20 kgf |

(4) glass transition temperature

Glass transition temperature was obtained from an endothermic curve with a programming rate of 5° C./min by employing a differential scanning calorimeter, "DSC-20" (produced by K. K. Seiko Denshi).

[EXAMPLES]

The present invention is explained ill more detail with reference to working examples but the present invention is not limited by these examples.

Example A

First, the following 22 kinds of binder resins were prepared as sample toner binder resins.

[Binder resin 1]

Butadiene-modified epoxy resin containing as indispensable constitutive components bisphenol A type epoxy oligomer, bisphenol A, and terminal carboxyl-modified butadiene and having 15 wt % of polybutadiene incorporated in the main chain structure of the epoxy resin.

[Binder resin 2]

Butadiene-acrylonitrile-modified epoxy resin containing as indispensable constitutive component bisphenol A type epoxy oligomer, bisphenol A, and terminal carboxyl-modified acrylonitrile and having 17 wt % of a butadiene-acrylonitrile copolymer introduced into the main chain structure.

Binder resin 2 was prepared in the way as mentioned below.

4000 g of bisphenol A type epoxy oligomer, 1322 g of bisphenol A, 532 g of a terminal carboxyl-modified butadiene-acrylonitrile copolymer (number average molecular weight: 3500; 1.85 carboxyl group being contained in a molecule) and 600 g of xylene were added into a 10 l separable flask equipped with a thermometer and an agitator, and the temperature of the mixture was elevated to 120° C. in a nitrogen atmosphere. A solution obtained by dissolving 0.9 g of triphenylphosphine into 50 g of xylene was added to the mixture as a catalyst.

Subsequently, the temperature of mixture was elevated to 150° C., while xylene was removed by vacuum distillation. After xylene had been distilled off, the mixture was restored to a nitrogen atmosphere, and reacted for 7 hours at a temperature of 150° C.

100 parts by weight of the thus obtained reaction product and 8 parts by weight of an ethylene-acrylic acid copolymer were kneaded for 30 min with a roll heated to a temperature of 130° C., so that a modified epoxy (Binder resin 2) was obtained.

Binder resin 1 and the following Binder resins 3 to 8 were obtained in the same way as described above.

[Binder resin 3]

Isoprene-modified epoxy containing as indispensable constitutive components bisphenol A type epoxy oligomer, bisphenol A and terminal carboxyl-modified isoprene and having 22 wt % of isoprene introduced into the main chain structure of epoxy resin.

[Binder resin 4]

Partially crosslinked butadiene-acrylonitrile-modified epoxy containing as indispensable constitutive component bisphenol A type epoxy oligomer, bisphenol A and terminal carboxyl-modified butadiene-acrylonitrile and novolac and having 13 wt % of butadiene-acrylonitrile copolymer incorporated into the main chain structure of epoxy resin.

[Binder resin 5]

Partially crosslinked butadiene-acrylonitrile-modified epoxy containing as indispensable constitutive components bisphenol A type epoxy oligomer, bisphenol A and terminal amino-modified butadiene-acrylonitrile and having 10 wt % of butadiene-acrylonitrile copolymer in the main chain structure of epoxy resin.

[Binder resin 6]

Partially crosslinked butadiene-acrylonitrile-modified epoxy containing as indispensable constitutive components bisphenol A type epoxy oligomer, bisphenol A and terminal carboxyl-modified butadiene-acrylonitrile and methoxylenediamine and having 13 wt % of butadiene-acrylonitrile copolymer incorporated into the main chain structure of epoxy resin.

[Binder resin 7]

Isoprene-modified epoxy containing as indispensable constitutive components polyethylene terephthalate oligomer and terminal carboxyl-modified isoprene and having 10 wt % of isoprene introduced into the main chain structure of polyethylene terephthalate.

[Binder resin 8]

Partially crosslinked butadiene-acrylonitrile-modified epoxy containing as indispensable constitutive components ethylene glycol, 1,2-butylene glycol, polyoxyethylenated bisphenol A, terephthalic acid, isophthalic acid, polyester oligomer containing 2-methyl terephthalic acid as indispensable constitutive component, and terminal carboxyl-modified butadiene-acrylonitrile, and having 10 wt % of butadiene-acrylonitrile copolymer in the main chain structure of the above polyester.

[Binder resin 9]

Partially crosslinked butadiene-acrylonitrile-modified styrene acryl containing, as indispensable constitutive components, terminal hydroxylated carboxy-modified isoprene containing as indispensable components styrene, divinylbenzene, n-butyl acrylate and hydroxymethyl acrylate, and terminal carboxyl-modified isoprene.

[Binder resin 10]

Crosslinked styrene acryl containing styrene, divinylbenzene and n-butyl acrylate as indispensable constitutive components.

[Binder resin 11]

Aliphatic carboxylic acid-modified epoxy containing as indispensable constitutive components bisphenol A type epoxy oligomer and long chain aliphatic carboxylic acid, in which the long chain aliphatic carboxylic acid is grafted.

[Binder resin 12]

Lactone-modified epoxy containing as indispensable constitutive components bisphenol A type epoxy oligomer and polycaprolactone, in which the polycaprolactone is grafted.

[Binder resins 13 and 14]

Polyesters containing as indispensable constitutive components polyoxyethylenated bisphenol A, polyoxypropylenated bisphenol A, terephthalic acid and trimellitic acid.

As resins to be blended with the main chain-modified copolymer, the following 8 kinds of resins were prepared as samples.

[Binder resins 15, 16 and 17]

Bisphenol A type epoxy resins

[Binder resin 18]

Crosslinked epoxy resin obtained by partially crosslinking bisphenol A type epoxy by the use of aminocresol.

[Binder resin 19]

Styrene acryl resin containing styrene and ethylhexyl acrylate as indispensable constitutive components.

[Binder resin 20]

Polyester containing as indispensable constitutive components ethylene glycol, 1,2-butylene glycol, terephthalic acid, isophthalic acid and 2-methylterephthalic acid.

[Binder resin 22]

Polyester containing as indispensable constitutive components polyoxyethylenated bisphenol A, polyoxypropylenated bisphenol A, terephthalic acid, isophthalic acid and trimellitic acid.

The physical property values of the above resins are set forth in Table 3. Furthermore, toners were prepared as samples by employing the above resins and mixtures thereof as binder resins. Evaluation results of toners obtained by employing the binder resins individually are set forth in Table 4. The mixing ratios of the binder resins, physical properties and evaluation results of the toners are set forth in Table 5. The trial preparation of the toners was carried out by the following method.

First, to the binder resins were added 5 parts by weight of carbon black ("Black Pearls" produced by Cabot Co., Ltd.) and 3 parts by weight of nigrosine dyestuff ("Bontron N-04" produced by Orient Kagaku K. K.), and the obtained mixture was melted and kneaded in a pressure kneader for 30 min at a temperature of 130° C. to thereby obtain a toner cake. The thus obtained toner cake was cooled and converted into rough granular toner with a particle diameter of about 2 mm, by a rotoprex pulverizer.

The thus obtained rough granular toner was pulverized and classified by employing a crushing classifying machine (IDS-3 type crushing-classifying machine manufactured by Japan Newmatic Industries Co., Ltd.) to thereby obtain a powdered toner A with a particle diameter of from 5 to 20 μm.

The evaluations of fixability and void forming state were conducted as described below.

First, a developer was prepared by adding 5 parts by weight of a toner to 95 parts by weight of magnetite powder employed as carrier, to the particles of which a resin coating had been applied, (produced by Kanto Denka K. K.; average particle diameter: 110 μm) and the fixing of the toner was carried out by employing a FACOM-6715D laser printer (manufactured by Fujitsu K. K.) adopting a light fixing method. The thickness of the toner on a recording paper was set within 10 to 15 μm. The set conditions of the fixing device were as follows. Employing a capacitor with a capacity of 160 μF, a charging voltage thereof was set as 2150 V, was applied to the lamp to thereby cause it to generate light so that the toner on the above recording paper was fixed.

With regard to the evaluation of fixability of a toner an adhesive tape ("Scotch Mending Tape" produced by Sumitomo 3M Co., Ltd.) was applied to a recording paper with a toner fixed, an iron cylindrical block with a section diameter of 100 mm and a thickness of 20 mm was rolled on the above tape in its circumferential direction at a constant speed so that the tape is closely adhered to the recording paper, and then the thus adhered tape was peeled off, whereupon the ratio of the optical density of the picture image before the peeling of the tape to that of the image after the peeling thereof was represented by a percentage, which became the evaluation of fixability of the toner.

The determination of optical density was carried out by employing a PCM meter produced by Macbeth Co., Ltd. In the evaluation Table, the fixability when the percentage of the optical density of the image after the peeling of the tape to that of the image before the peeling thereof was above 95% was marked ⊙, that when the percentage ranging from 90 to 95% was ○, that with the percentage ranging from 75 to 90% was Δ, that with the percentage ranging from 30 to 75% was x, and that with the percentage below 30% was xx.

The void forming appearance was visually evaluated.

With respect to the blocking of a toner, after the toner had been left as it was for 3 hours under the conditions of 55° C. and 30% R.H., the blocking state was visually evaluated. With regard to the pulverizabilities of toners, the amounts of the produced toners employing therein each of the binder resins were respectively evaluated on the basks of the amount of the produced toner per unit time, where the toner containing as binder resin bisphenol A diglycidylether polymer commonly used as binder resin for light fixing was pulverized by employing a jet pulverizer.

As the evaluation results of pulverizabilities of toners, the pulverizability of the toner which could be pulverized in an amount equal to or greater than the toner containing bisphenol A diglycidylether polymer was represented by ⊙, that of a toner exhibiting 90% or more toner based on the above standard toner by ○, that of same which could be pulverized in an amount ranging from 80 to 90% based on the standard toner by Δ, that of a toner pulverized in percentage ranging from 50 to 80% by x, and that of a toner exhibiting the pulverization amount below the above range by xx.

As indicated in Tables 3 and 4, the toner employing a binder resin with a melt viscosity and storage modulus at a temperature of 200° C. of, respectively, 100 poises or more and 100 dyne/cm$^2$ or more has an excellent void formation preventing ability, and the toner employing a binder resin with a melt viscosity below 5000 poises and storage modulus below 40000 dyne/cm$^2$ both at a temperature of 125° C. has an excellent fixability, and in binder resins No. 2, No. 7 and No. 8, which have an excellent fixability and void formation preventing ability, both the low temperature melt viscoelasticity and high temperature melt viscoelasticity satisfy the ranges of the present invention.

The above results are illustrated in FIG. 2 and FIG. 3.

In FIG. 2, the melt viscosities at temperatures of 125° C. and 200° C. of the above binder resin are plotted. The values within the ranges of the present invention are shown in the slash marked region.

FIG. 3 is an illustration plotting the storage moduli at temperatures of 125° C. and 200° C. regarding the above binder resin. The values within the ranges of the present invention are shown in the slash marked region.

Furthermore, binder resins, No. 2, No. 3, No. 6 and No. 9, which have an excellent void formation preventing ability, and binder resins No. 16, No. 18, No. 20 and No. 21, which have an excellent blocking resistance, among the above binder resins, were, respectively blended with each other to form binder resin mixtures, which were converted into toners, and the properties of the obtained toners were evaluated (refer to Table 5).

As explained above, according to the present invention, toners having an excellent void resistance and fixability, and an excellent blocking resistance, are obtained.

TABLE 1

| Toner | Heating furnace temperature at which gas components produced by light decomposition of toner resin was the same as gas components produced by the thermal decomposition of the toner resin |
|---|---|
| A | 180° C.–250° C. |
| B | above 200° C. |
| C | above 180° C. |

TABLE 2

| Melting point of toner | Pure substance which was melted when a good fixability was given |
|---|---|
| 90 | substance with a melting point lower than that of phenidone (melting point: 121° C.) |
| 105 | substance with a melting point lower than that of phenidone (melting point: 121° C.) |
| 115 | substance with a melting point lower than that of phenidone (melting point: 121° C.) |
| 125 | substance with a melting point lower than that of phenacetin (melting point: 135° C.) |
| 138 | substance with a melting point lower than that of phenacetin (melting point: 135° C.) |
| 150 | toner not fixed by the irradiation of Xenon light |

TABLE 3

| Binder resin No. | Melt viscoelasticity 125° C. Melt viscosity | 125° C. storage modulus | 200° C. melt viscosity | 200° C. storage modulus | Surface tension | Molecular weight Mw | Melting point |
|---|---|---|---|---|---|---|---|
| 1 | 1500 | 10900 | 120 | 140 | 24 | 12000 | 108 |
| 2 | 1000 | 10000 | 160 | 200 | 26 | 16000 | 104 |
| 3 | 2200 | 12000 | 120 | 140 | 24 | 24000 | 100 |
| 4 | 3800 | 16000 | 120 | 140 | 28 | 17500 | 104 |
| 5 | 1000 | 10000 | 100 | 120 | 30 | 10000 | 104 |
| 6 | 3800 | 18000 | 140 | 160 | 27 | 19000 | 109 |
| 7 | 2500 | 30000 | 120 | 120 | 30 | 9000 | 115 |
| 8 | 4500 | 40000 | 200 | 400 | 24 | 10000 | 108 |
| 9 | 5500 | 60000 | 200 | 450 | 20 | 12000 | 11 |
| 10 | 6000 | 60000 | 180 | 320 | 20 | 12000 | 115 |
| 11 | 3000 | 21000 | 100 | 90 | 28 | 7000 | 98 |
| 12 | 7000 | 100000 | 250 | 300 | 24 | 12000 | 112 |
| 13 | 3000 | 35000 | 50 | 110 | 26 | 18000 | 110 |
| 14 | 10000 | 20000 | 200 | 160 | 28 | 110000 | 138 |
| 15 | 1000 | 15000 | 30 | 30 | 26 | 4300 | 88 |
| 16 | 1800 | 33000 | 50 | 50 | 25 | 6000 | 96 |
| 17 | 3500 | 90000 | 110 | 140 | 24 | 10000 | 120 |
| 18 | 1500 | 35000 | 80 | 80 | 28 | 7000 | 100 |
| 19 | 7000 | 85000 | 120 | 220 | 22 | 9000 | 125 |
| 20 | 3800 | 65000 | 70 | 120 | 24 | 10000 | 120 |
| 21 | 2800 | 50000 | 50 | 100 | 26 | 8000 | 120 |
| 22 | 10000 | 250000 | 1000 | 800 | 24 | 200000 | 145 |

TABLE 4

| Kind of binder resin | Fixability | Blocking resistance | Void formation state | Pulverisability |
|---|---|---|---|---|
| 1 | Δ | x | ○ | x |
| 2 | ○ | x | ◎ | x |
| 3 | Δ | x | ◎ | xx |
| 4 | Δ | Δ | ○ | x |
| 5 | ○ | x | Δ | Δ |
| 6 | Δ | Δ | ◎ | x |
| 7 | ○ | ○ | ○ | Δ |
| 8 | ○ | ○ | ○ | Δ |
| 9 | x | ○ | ◎ | Δ |
| 10 | x | x | ○ | ○ |
| 11 | ○ | x | Δ | ○ |
| 12 | x | x | Δ | x |
| 13 | ○ | Δ | x | ○ |
| 14 | xx | ○ | ◎ | ○ |
| 15 | ○ | x | xx | ◎ |
| 16 | ○ | Δ | xx | ◎ |
| 17 | x | Δ | Δ | ◎ |
| 18 | ○ | Δ | x | ◎ |
| 19 | Δ | ○ | Δ | ○ |
| 20 | ◎ | ◎ | x | ◎ |
| 21 | ○ | ◎ | Δ | ○ |
| 22 | Δ | ◎ | ◎ | Δ |

TABLE 5

| Toner | Binder resin 1) | Surface tension | Physical properties of binder resin: 125° C. melt viscosity | 125° C. storage modulus | 200° C. melt viscosity | 200° C. storage modulus | Fixability | Void formation state | Blocking resistance | Pulverizability |
|---|---|---|---|---|---|---|---|---|---|---|
| 23 | 16(70) + 2(30) | 22 | 1600 | 33000 | 120 | 140 | ◎ | ○ | ○ | ○ |
| 24 | 16(80) + 3(20) | 23 | 1800 | 30000 | 140 | 160 | ○ | ◎ | ○ | Δ |
| 25 | 16(70) + 9(30) | 18 | 2400 | 40000 | 140 | 200 | ○ | ◎ | ○ | ○ |
| 26 | 18(75) + 2(25) | 28 | 1200 | 30000 | 120 | 120 | ○ | ◎ | ○ | ○ |
| 27 | 20(80) + 2(20) | 24 | 2800 | 28000 | 120 | 120 | ◎ | ○ | ◎ | ◎ |
| 28 | 20(70) + 2(30) | 21 | 3200 | 29000 | 140 | 160 | ◎ | ◎ | ○ | ○ |
| 29 | 20(70) + 6(30) | 24 | 3000 | 39000 | 120 | 120 | ○ | ○ | ◎ | ○ |
| 30 | 21(70) + 9(30) | 22 | 4500 | 39000 | 140 | 160 | ○ | ◎ | ◎ | ○ |

1) The numerals are binder resin No. used for blending. The numerals in ( ) are, respectively, wt % based on respectively used binder resins.

Example B-1

First, to 92 parts by weight of an epoxy resin (bisphenol A glycidyl ether; epoxy equivalent: 900 to 1000) as binder resin, there were added 0.5 part by weight of a pendant type silicone polymer (produced by Nihon Unitica Co., Ltd.) as surface tension decreasing agent, and as colorants, 5 parts by weight of carbon black ("Black Pearls L" produced by Cabot Co., Ltd.; average particle diameter: 0.024 μm, specific surface area: 138 $m^2/g$) and 3 parts by weight of nigrosine dye (Oil Black BY produced by Orient Kagaku K. K.), and the obtained mixture was melted and kneaded in a pressure kneader for 30 min, at a temperature of 130° C., so that a toner cake was obtained, and the toner cake was cooled and pulverized to obtain a rough granular toner with a particle diameter of about 2 mm, by a rotoprex pulverizer.

Subsequently, the rough granular toner was finely pulverized by a jet mill ("PJM Pulverizer" produced by Japan Newmatic Co., Ltd.) and the thus obtained powder was classified by an air classifier (produced by Alpine Co., Ltd.), so that a positively charged toner with a particle diameter of from 5 to 20 μm was obtained.

Subsequently, the developer consisting of 5 parts by weight of toner A and 95 parts by weight of amorphous iron powder, "TSV 100/200" (produced by Nihon Teppun K. K.) was prepared as carrier and with the prepared developing agent, printing test was carried out by employing an improved machine of "FACOM-6715" laser printer and the optical density of the obtained picture image was determined. The judgement of void formation states was conducted visually. The surface tension of the toner was determined at a temperature of 200° C. by employing a surface tension measuring equipment ("Degiomatic ESB-V" manufactured by Kyowa Kagaku K. K.).

The result of the printing test showed that toner A had an excellent void resistance and a printing density of 1.1, and the surface tension of toner A was 15 dyne/cm. (refer to the added Table).

Example B-2

First, to 92 parts by weight of polyester (polyethylene terephthalate; number-average molecular weight: 1000) with 1.0 part by weight, based on the weight of the resin, of silicone polymer added, said polyester being employed as binder resin, there were further added 5 parts by weight of carbon black and 3 parts by weight of nigrosine dye as colorants, and the obtained mixture was melted and kneaded in a pressure kneader for 30 min. at a temperature of 130° C., so that a toner cake was obtained, and the obtained toner cake was cooled and was converted into a rough granular toner with a particle diameter of about 2 mm, by a rotoprex pulverizer.

Subsequently, the obtained rough granular toner was finely pulverized by a jet mill and the obtained powder was classified by an air classifier, so that positively charged toner B with a particle diameter of from 5 to 20 μm was obtained.

The result of the evaluation of printing showed that toner B had an excellent void resistance, and an optical density was 1.2, and the surface tension of toner B was 13 dyne/cm (refer to the table).

Example B-3

First, employing as binder resins 62 parts by weight of styrene acryl with 2.0 parts by weight, based on the resin weight, of silicone polymer added and 30 parts by weight of a polyester resin (polyethylene terephthalate; number-average molecular weight: 1000) with no silicone polymer added, 3 parts by weight of carbon black (Black Pearls L) and 3 parts by weight of nigrosine dye were further added as colorants to the binder resins, and the obtained mixture was melted and kneaded by a pressure kneader for 30 min at a temperature of 130° C., so that a toner cake was obtained. Subsequently, the obtained toner cake was cooled and pulverized into a rough granular toner with a particle diameter of about 2 mm by a rotoprex pulverizer.

Then, the obtained rough granular toner was finely pulverized by a jet mill (PJM pulverizer) and the obtained fine powder was classified by an air classifier (manufacture by Alpine Co., Ltd.), so that a positively charged toner C with a particle diameter of from 5 to 20 μm was obtained.

The result of the evaluation of printing showed that toner C had an excellent void resistance and an optical density of 1.3, and the surface tension of toner C was 10 dyne/cm (refer to the table).

Comparative Example 1

The process in Example 2 was repeated except that, at the time of melting and kneading the toner silicone polymer was not added as a surface tension reducing agent, so that toner E was obtained. When a printing test and the determination of surface tension of the toner were carried out in the same way as in Example 1, many voids were formed during the printing of this toner and the printing density was 0.8. The surface tension of toner D was 25 dyne/cm (refer to the table).

Comparative Example 2

The process in Example 2 was repeated except that silicone polymer was not added as a surface tension reducing agent, so that toner E was obtained. When a printing test and the determination of surface tension of the toner were carried out in the same way as in Example 1, many voids were formed during the printing of this toner and the printing density was 0.7. The surface tension of toner D was 23 dyne/cm (refer to the added table).

Comparative Example 3

The process in Example 1 was repeated except that 92 parts by weight of an epoxy resin were employed as binder resin and 3 parts by weight of silicone polymer were added thereto as surface tension reducing agent, so that toner F was obtained. When the evaluation of the printing and the determination of surface tension of the toner were carried out in the same way as in Example 1, very many voids were formed in the printing of this toner and the printing density was 0.7. The surface tension of toner F was 9 dyne/cm (refer to the added table).

Comparative Example 4

The process in Example 3 was repeated except that silicone polymer was not added to styrene acryl as a surface tension reducing agent, so that a toner G was obtained. When a printing test and the determination of surface tension of the toner were carried out in the same way as in Example 1, many voids were formed in the printing of this toner and the printing density was 0.6. The surface tension of toner G was 33 dyne/cm (refer to the added table).

TABLE

| | Evaluation of toners prepared as samples | | | | | | |
|---|---|---|---|---|---|---|---|
| | Example 1 | Example 2 | Example 3 | Comparative Example 1 | Comparative Example 2 | Comparative Example 3 | Comparative Example 4 |
| Binder resin | epoxy | polyester | poly-ester styrene-acryl | epoxy | polyester | epoxy | polyester styrene-acryl |
| Amount of added surface tension decreasing agent | 0.5 | 1.5 | 2.0 | 0 | 0 | 3.0 | 0 |
| Surface* tension | 15 | 13 | 10 | 25 | 23 | 9 | 33 |
| Void formation preventing characteristic | o | o | o | x | x | x | x |
| Printing density | 1.1 | 1.2 | 1.3 | 0.8 | 0.7 | 0.7 | 0.6 |
| Melt viscosity* | 30 | 30 | 50 | 50 | 50 | 20 | 90 |

*Measured values at a temperature of 200° C.

As explained above, according to the present invention, a toner excellent in void resistance may be obtained without worsening the fixability and blocking resistance thereof.

We claim:

1. A toner for the use in a flash light fixing apparatus which carries out fixing of the toner by means of a flash light, comprising at least two binder resins, wherein the blended binder resins have, at a temperature of 200° C., a surface tension below 30 dyne/cm, a melt viscosity of 100 poises or more, and a storage modulus of 100 dyne/cm$^2$ or more, and the blended binder resins have, at a temperature of 125° C., a melt viscosity below 5000 poises and a storage modulus below 40,000 dyne/cm$^2$, said toner being fixed by the flash light fixing apparatus.

2. A toner for use in a flash light fixing apparatus which carries out fixing of the toner by means of a flash light, comprising a copolymer binder resin having a modified main chain, the main chain of the binder resin being formed by polymerization of a first prepolymer or monomer, said main chain of the binder resin being modified by introducing (a) a second prepolymer with 1.5 equivalent or more of a functional group exhibiting rubber-like elasticity at room temperature and being reactive with said first prepolymer or monomer, or (b) a monomer convertible into the same substance as said second prepolymer by the polymerization thereof, said copolymer binder resin having, at a temperature of 200° C., a surface tension below 30 dyne/cm, a melt viscosity of 100 poises or more, and a storage modulus of 100 dyne/cm$^2$ or more, and having, at a temperature of 125° C., a melt viscosity below 5,000 poises and a storage modulus below 40,000 dyne/cm$^2$, said toner being fixed by the flash light fixing apparatus.

3. A toner for the use in a flash light fixing apparatus which carries out fixing of the toner by means of a flash light, comprising a surface tension reducing agent and a binder resin, a melt viscosity of said binder resin and a surface tension thereof both at a temperature of 200° C. are, respectively, 30 poises or more and below 15 dyne/cm, the surface tension reducing agent comprised of polydimethylsiloxane-polyether, polydimethylsiloxane-polyester represented by the following general formulas:

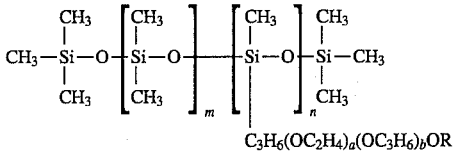

R: an alkyl group or H, 0.1<b/a<10;

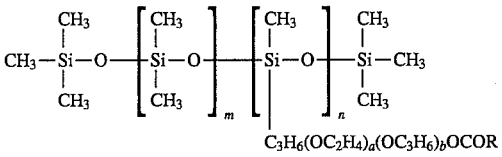

R: an alkyl group or H, 0.1<b/a<10; fluorine polymers represented by the following formula:

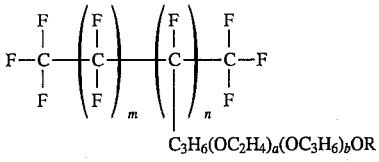

R: an alkyl group or H, 0.1<b/a<10;

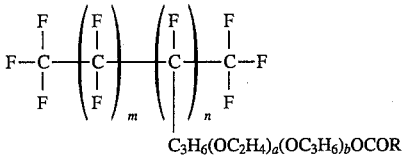

R: an alkyl group or H, 0.1<b/a<10;

polyethylene glycol ether or polyethylene glycol polyester represented by the following formula:

$$RCOO(CH_2CH_2O)_nOR'$$

wherein R and R', respectively, represent an alkyl group or a hydrogen atom and $40 \geqq n \geqq 10$; or $$RCOO(CH_2CH_2O)_nCOR',$$

wherein R and R', respectively represent an alkyl group or a hydrogen atom and $40 \geqq n \geqq 10$, or polyethylene wax and polypropylene wax represented by the following general formula

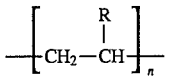

wherein R is a hydrogen atom or $CH_3$, said toner being fixed by the flash light fixing apparatus which carries out fixing of toner by means of a flash light.

4. A toner according to claim 1, wherein said blend consists of a first binder resin with a melt viscosity of 30 poises or more and a storage modulus of 50 dyne/cm$^2$ or more both at a temperature of 200° C., and a melt viscosity below 3000 poises and a storage modulus below 35000 dyne/cm$^2$ both at a temperature of 125° C., and a second binder resin with a melt viscosity of 120 poises or more and a storage modulus of 120 dyne/cm$^2$ or more both at a temperature of 200° C., and a melt viscosity below 10000 poises and a storage modulus below 100000 dyne/cm$^2$ both at a temperature of 125°.

* * * * *